United States Patent [19]

Chance et al.

[11] 4,452,120

[45] * Jun. 5, 1984

[54] TUNING PEG ASSEMBLY

[75] Inventors: Slim Chance, Mill Valley; William T. Gray, Topanga, both of Calif.

[73] Assignee: John Caruth, Richardson, Tex. ; a part interest

[ * ] Notice: The portion of the term of this patent subsequent to Jan. 11, 2000 has been disclaimed.

[21] Appl. No.: 444,786

[22] Filed: Nov. 26, 1982

Related U.S. Application Data

[63] Continuation of Ser. No. 231,818, Feb. 5, 1981, abandoned, which is a continuation-in-part of Ser. No. 184,702, Sep. 18, 1980, Pat. No. 4,367,671.

[51] Int. Cl.[3] ..... G10D 3/14

[52] U.S. Cl. ..... 84/306

[58] Field of Search ..... 84/200, 204, 205, 304, 84/305, 306, 458, 459

[56] References Cited

U.S. PATENT DOCUMENTS

| | | | |
|---|---|---|---|
| 918,543 | 4/1909 | Haubner | 84/306 |
| 1,713,002 | 5/1929 | Oettinger | 84/304 |
| 3,023,658 | 3/1962 | Gusey | 84/306 |
| 3,830,132 | 8/1974 | Lowe | 84/304 |
| 4,367,671 | 1/1983 | Chance et al. | 84/306 |

*Primary Examiner*—Lawrence R. Franklin

*Attorney, Agent, or Firm*—Thomas L. Crisman; Stanley R. Moore

[57] ABSTRACT

An adjustable clutched handle for turning the drive shaft of a tuning peg assembly on a stringed instrument, such as a guitar, and a linear extension tightening post. The clutched handle includes a tubular handle element having a transverse hole formed perpendicular to the axis of the handle element. A generally tubular adapted sleeve, keyed to the end of the drive-shaft, includes a pair of flat drive surfaces on its outer surface. A pair of pistons, sized for movement along the axial bore, are biased against the drive surfaces by a pair of springs. The springs are held in place against the pistons by an adjustable cap. When a predetermined tension has been reached, the force of the springs holding the piston against the drive surfaces is overcome to allow the handle to free-wheel about the drive shaft. The provision of a linear extension tightening post reduces the tendency for the instrument to become out of tune.

1 Claim, 4 Drawing Figures

TUNING PEG ASSEMBLY

This application is a continuation of copending application Ser. No. 231,818 filed Feb. 5, 1981, now abandoned which was a continuation-in-part application of prior application Ser. No. 184,702, filed Sept. 18, 1980, now U.S. Pat. No. 4,367,671.

BACKGROUND

Stringed instruments, such as pianos, guitars, sitars, banjoes, and so forth must have their strings tightened to the proper tension to be in tune. When tuning pianos a ratcheted wrench, such as disclosed in U.S. Pat. No. 757,878, is often used. However, such ratcheted wrenches merely reposition the turning handle for the convenience of the user. Proper tension is still determined by ear.

Other stringed instruments, such as guitars, have handles as integral parts of their tuning peg assemblies. U.S. Pat. No. 3,813,983 discloses a motor powered string tensioner. This device is designed to ease the chore of manually tightening the tension of this string. However, it still depends upon the user's aural perception to determine when to stop tightening the string. Thus, the user must pluck the string while using the motor driven device and determine, by ear, when the proper tension is reached.

Guitars and similar instruments usually have a tuning peg (tightening post) around which the string is wound to the proper tension. The tuning peg is commonly driven through a worm gear arrangement by a handle on a drive-shaft. The strings of the guitar, which are each wrapped about a tuning peg, are tightened by turning a handle on the drive-shaft. The strings are usually not a single strand of wire but have a core strand with a fine wrapping wound about the core. When these wrapped strings are wound about a peg, after a period of time the wrapping tends to flatten out where it presses against the peg. The string thereby moves somewhat closer to the post resulting in a loosening of the string. Thus the instrument becomes out of tune.

What has not been heretofore available is a device by which the strings on a guitar or other such instrument can be tightened to a pre-determined tension without being wrapped about a peg and without the need for the tuning by ear presently required. Such a device would allow a musician to quickly and simply retune the instrument during a performance by retightening the strings to a predetermined tension and would help insure that the instrument stays in tune.

SUMMARY OF THE INVENTION

Disclosed is a small and simply constructed adjustable clutched handle which allows the user to tighten guitar strings to a pre-determined tension and a linear extension tightening post which reduces the tendency for the instrument to become out of tune.

In the present invention the standard handle on a tuning peg assembly is replaced by the improved clutched handle. The clutched handle includes a tubular handle element having a transverse hole formed perpendicular to the axis of the handle element. A generally tubular adapter sleeve fits within the transverse hole and is keyed to the drive-shaft of the tuning peg assembly. The adapter sleeve has a pair of flat drive surfaces on its outer surface.

The adapter sleeve is mounted through the transverse bore within the handle element so that the drive surfaces can be aligned with an axial bore in the handle element. A pair of pistons, sized for movement along the axial bore, are biased against opposite sides of the outer surface of the adapter sleeve by a pair of springs. The springs are forced against the pistons by a cap screwed into one end of the axial bore.

The user tightens or loosens the guitar string by rotating the clutched handle about the axis of the transverse bore. When a pre-determined tension has been reached, the force of the springs holding the piston against the drive surfaces is overcome to allow the handle to freewheel about the transverse axis. The chosen string tension can be changed by varying the force of the springs acting upon the piston.

To insure that the chosen string tension achieved by the clutched handle is not lost, the present invention provides a tuning peg assembly having a linear extension tightening post to which the string is attached. The peg assembly includes a guide bar located near the surface of the tuning head under which the string passes. The end of the string is secured to the tightening post. Rotating the clutched handle moves the drive shaft upwardly away from the tuning head thus pulling the attached end of the string upward to tighten the string.

A primary advantage of the present invention is that the user can quickly retune a guitar by tightening the strings to a pre-determined tension with a mere twist of the handle. The "hunting" for the proper tension which presently must be performed in tuning a guitar by ear is eliminated. Thus, the user can accurately tune his instrument during a performance.

Another significant advantage results from the use of the linearly extending tightening post. Since the string is not wound about a rotatable peg, flattening of the windings is minimized so the string stays in tune a much longer time. It has been found that guitars using the linear tightening post of the present invention can remain in tune for days or weeks, a significant improvement over the tuning peg assemblies of the prior art.

The tuning peg assembly of the present invention does not use the worm gear drive of many prior art peg assemblies, but rather the drive shaft is coaxially aligned with the tightening post. This allows the tuning peg assembly to be smaller, lighter and less expensive than the prior art devices. The reduced weight is a significant advantage because it can lessen the fatigue of the musician as well as possibly improving the vibrational characteristics of the instrument. Also, when used with a clutched handle made according to the present invention, greater adjustment accuracy may be achieved because of the simplicity of the drive train.

The clutched handle of the present invention is both small and simple thus making it inexpensive to produce and easy to use. No large, bulky torque wrenches need be carried around by the user for the handle remains attached to the drive-shaft of the tuning peg assembly.

A separate clutched handle is usually mounted to each tuning peg assembly of the instrument. This allows the player to tailor the tension on each string of the instrument to produce the desired sound. The handle remains conveniently mounted on the drive-shaft of the tuning peg assembly to insure against loss.

The clutched handle of the invention is adjustable so the user can adjust the tension in the strings. This is accomplished by screwing the cap into or out of one end of the axial bore. This changes the amount the springs are compressed to change the force the springs exert against the pistons.

The clutched handle disclosed includes an adapter sleeve keyed to the drive shaft of the tuning peg assembly. By providing an adapter sleeve, several advantages accrue. Different methods of keying the sleeve to the drive shaft, other than the disclosed use of flats within the bore of the sleeve, can be used since the clutch drive surface is on the sleeve and not the drive shaft. Provision of an adapter sleeve allows the clutch drive surface to be of greater diameter to provide more precise control of the tightening force. Further, the sleeve is made from a material, such as nylon or polished aluminum, which can be made to have a very smooth clutch drive surface which wears well. The absence of surface irregularities insures smooth, reproducible operation. If the clutch drive surface ever wears out, the user need only replace the sleeve, an inexpensive part.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 2:
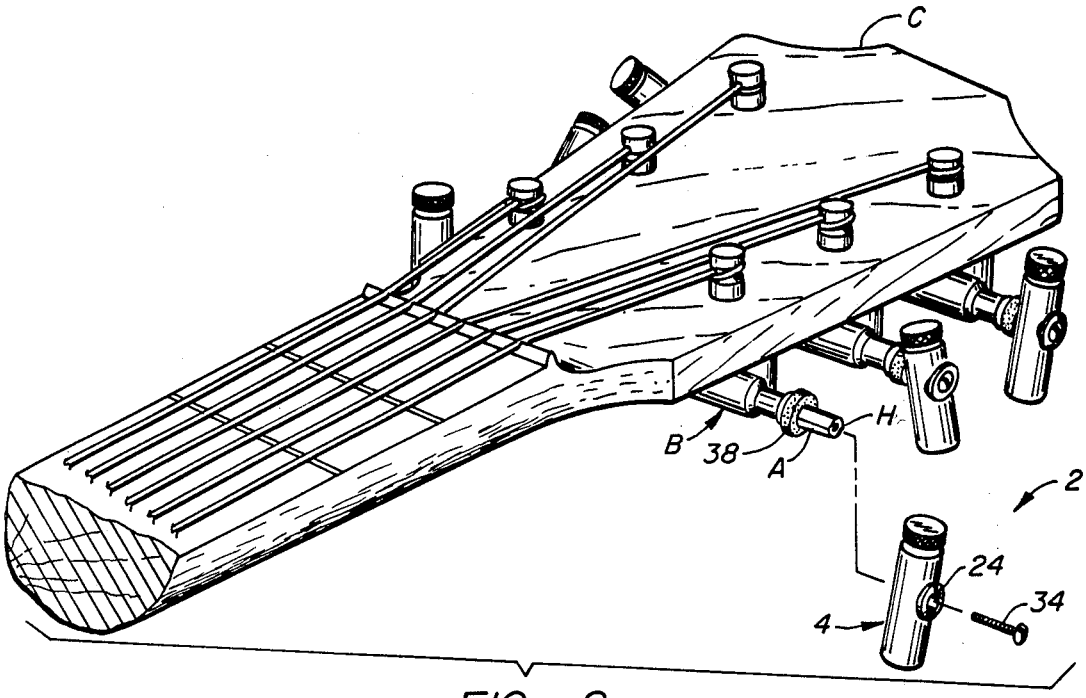
FIG. 2 is a perspective view of the tuning head of a guitar disclosing clutched handles mounted on each drive shaft of standard tuning peg assemblies.
Figure 1:
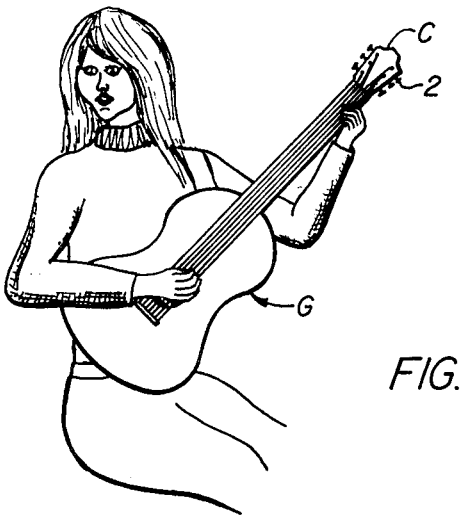
FIG. 1 shows a musician playing a guitar having the clutched handles of the invention mounted to the tuning peg assemblies.
Figure 3:
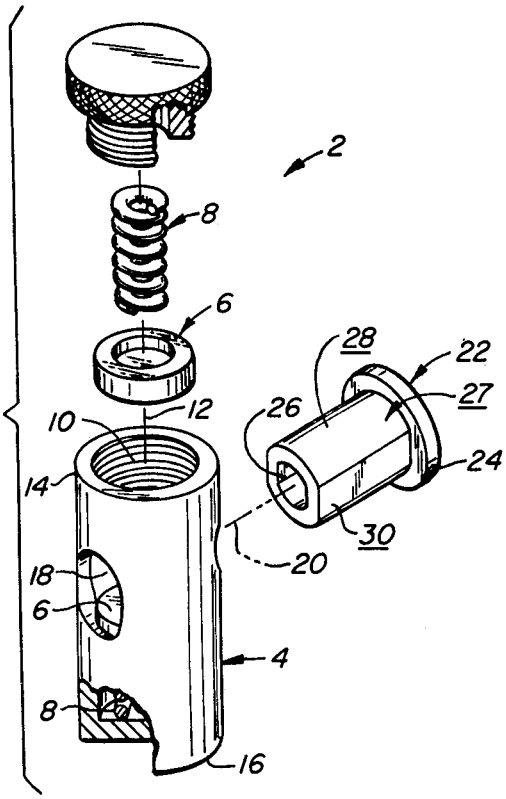
FIG. 3 is a partially exploded isometric view of the clutched handle.

Turning now to FIGS. 1-3, the clutched handle 2 of the present invention includes generally a tubular handle element 4, a pair of pistons 6, a pair of springs 8 and a cap 10.

The tubular handle element has an axial bore 11 along a piston axis 12 extending from first end 14 inwardly through the handle element to near the second end 16. An elongate transverse hole 18 is formed perpendicular to piston axis 12 and defines a drive shaft axis 20.

An adapter sleeve 22 having an outer shoulder 24 and a drive shaft bore 26 formed along drive shaft axis 20 is mounted within transverse hole 18.

The cap is threadably mounted to first end 14 and captures a pair of springs 8 and pistons 6 within the axial bore so that pistons 6 are forced against the clutched drive surface 27 of adapter sleeve 22. The clutched drive surfaces include arcuate portions 28 and a pair of diametrically opposed flats 30. The adapter sleeve is keyed to the drive shaft A of a standard tuning peg assembly B. Assembly B is mounted to the tuning head C of the guitar G. The clutched handle is fixed to drive shaft A by a screw 34 which threadably engages a threaded hole H within drive shaft A. A washer 38 is also mounted to drive shaft A so that the clutched handle turns more freely on the drive shaft.

Figure 4:
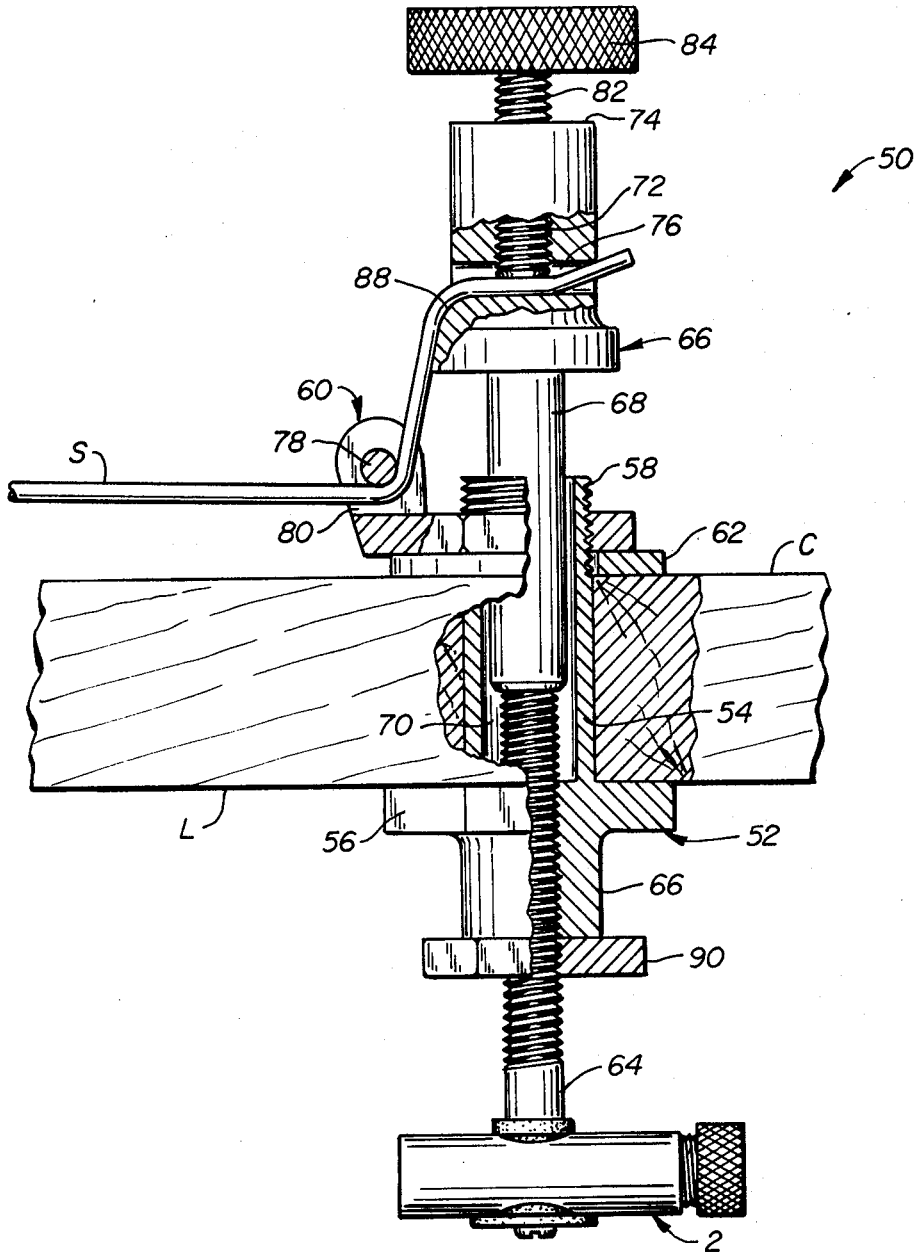
FIG. 4 is an enlarged side view of the linear extension tightening post mounted to the tuning head of a guitar with a clutched handle mounted to the drive shaft.

Turning to FIG. 4 the linear extension tuning peg assembly 50 will be described. Peg assembly 50 includes generally a tuning head mounting member 52 having a hollow cylindrical body portion 54 which is mounted within a correspondingly sized hole in tuning head C. Member 52 has an enlarged hexagonal portion 56 which abuts the lower surface L of tuning head C. The distal end 58 of body portion 54 is threaded for threadable engagement with a string guide 60. Member 52 is thereby secured between a washer 62 and hex portion 56 via distal end 58 and string guide 60. A drive shaft 64 threadably engages a lower end 66 of member 52 and has clutched handle 2 mounted at the outer end of shaft 64.

Peg assembly 50 also includes a tightening post 66 having a shaft 68 sized for insertion past distal end 58 into a bore 70 of body portion 54. Post 66 has a threaded axial hole 72 extending from the upper end 74 of post 66 and terminating at the intersection with a transverse hole 76. A string S passes around a guide bar 78 mounted between a pair of ears 80 on threaded string guide 60 and then up and through transverse hole 76. String S is secured within hole 76 of post 66 by a threaded locking screw 82 having a knurled handle 84 at its upper end. The lower edge 88 of transverse hole 76 is rounded to reduce the stress concentration on string S.

Although the operation of peg assembly 50 should now be apparent, its use will be described briefly. The user passes string S under guide bar 78, through transverse hole 76 and pulls it taut. Locking screw 82 is tightened down upon string S to secure it to tightening post 66. The user then rotates handle 2 causing drive shaft 64 to advance within bore 70 thus forcing shaft 68 up away from lower surface L of tuning head C. This causes string S to be tightened. When the proper tension is achieved, a locked nut 90 on drive shaft 64 is tightened against lower end 66 of member 52 to lock drive shaft 64 in place. It should be noted that peg assembly 50 is shown used with clutch handle 52 to provide quick proper tensioning. However, a standard, non-clutched handle can also be used in lieu of clutched handle 2 if desired.

Using the clutched handle of the present invention with standard tuning peg assembly B proceeds generally as follows. The user mounts a washer 38 over the drive shaft H of each tuning peg assembly B mounted to the tuning head of the guitar. The clutched handle is then mounted over the drive shaft along drive shaft axis 20 so that the drive shaft is inserted into bore 26 of the adapter sleeve. The handle is then secured to the drive shaft by screw 34. The user then tightens the string until the clutch force of the pistons riding against flat 30 is exceeded so that the pistons move against the springs allowing the handle to free wheel about the drive shaft. The string is then plucked to see if the proper tone is achieved. If the proper tone is not so achieved, the cap is adjusted either increasing or decreasing the force of the spring against the piston as needed. After each individual clutched handle is so adjusted, when it becomes necessary to retune the instrument by tightening a string, the user merely rotates appropriate clutch handle until it begins to free wheel thus indicating the proper tension has been achieved. No hunting for the proper tension is therefore required.

In the preferred embodiment a single cap has been used to provide an adjustable force by the pistons against the adapter sleeve. If desired two caps could be used, one at each end of the tubular handle element. Also, it should be noted that the transverse hole is an elongate hole, lengthed along piston axis 12. This insures that the adapter sleeve can somewhat float between the two pistons. Other means for changing the force on the pistons could also be used. For example, a number of different springs can be used having different spring constants or different pistons could be provided having different thicknesses to either increase or decrease the force applied against the clutch drive surface of the adapter sleeve.

The clutched handle of the present invention is provided with an adapter sleeve 22 for keyed engagement with drive shaft A. However, if the drive shaft has a suitable clutch drive surface and is of sufficient diameter so that accurate tensioning can be achieved, no adapted sleeve may be needed.

If desired tightening post 66 could be mounted generally parallel to tuning head C for movement parallel to string S. This could eliminate the need for guide bar 78 and may help reduce further the tendency of the strings to go out of tune because the area of the windings of string S lying against guide bar 78 would be eliminated.

Other modification and variation may be made to the present embodiment without departing from what is regarded as to be the invention.

I claim:

1. A tuning peg assembly for use on stringed instruments comprising:

a moveable string tightening post being mounted to said instrument for movement along a substantially linear first path;

a rotatable drive shaft;

means operably coupling said drive shaft and said tightening post;

a handle mounted to said drive shaft generally transverse to the axis of rotation of said drive shaft; and means for adjustably clutchably driving said drive shaft.

* * * * *